US005088514A

United States Patent [19]

House et al.

[11] Patent Number: 5,088,514

[45] Date of Patent: Feb. 18, 1992

[54] TANNING AND SCREENING APPARATUS

[76] Inventors: J. C. House; Jonathan C. House, both of 4701 Lake Shore, Port Arthur, Tex. 77640

[21] Appl. No.: 519,340

[22] Filed: May 2, 1990

Related U.S. Application Data

[63] Continuation of Ser. No. 206,253, Jun. 13, 1988, abandoned.

[51] Int. Cl.[5] ..... E04H 15/46

[52] U.S. Cl. ..... 135/107; 135/109; 135/112; 135/113

[58] Field of Search ..... 135/904, DIG. 9, 109, 135/112, 113, 105, 107; 128/372, 373

[56] References Cited

U.S. PATENT DOCUMENTS

| | | | |
|---|---|---|---|
| 2,615,459 | 10/1952 | Adams | 135/904 |
| 2,675,807 | 4/1954 | Pursel | 128/372 |
| 2,819,776 | 1/1958 | Balsam | 135/904 X |
| 2,886,047 | 5/1959 | Healy | 135/904 |
| 2,981,256 | 4/1961 | Besnah | 128/372 |
| 3,050,067 | 8/1962 | Trafton | 128/372 |
| 3,133,549 | 5/1964 | Severing | 135/109 |
| 3,404,696 | 8/1968 | Filho | 135/904 |
| 3,463,577 | 8/1969 | Friedberg | 128/372 |
| 3,610,249 | 10/1971 | Baker | 128/372 |
| 3,625,434 | 4/1970 | Kitover | 128/372 |
| 3,947,903 | 4/1976 | Menke | 5/111 |
| 4,205,684 | 6/1980 | Lassy | 128/377 |
| 4,470,630 | 9/1984 | Shields | 297/118 |
| 4,635,667 | 1/1987 | Harn | 135/90 |
| 4,687,249 | 8/1987 | Mills | 297/184 |

*Primary Examiner*—Richard E. Chilcot, Jr.
*Assistant Examiner*—Lan Mai

[57] ABSTRACT

A tanning and screening apparatus includes a folding frame, a panel stretched over the frame and having a sun reflecting surface, and legs having an adjustable length and being pivotally connected to the frame. The apparatus may assume a plurality of different positions and may be used to reflect the sun towards an individual or to protect an individual from the sun or the wind.

16 Claims, 3 Drawing Sheets

FIG. 1
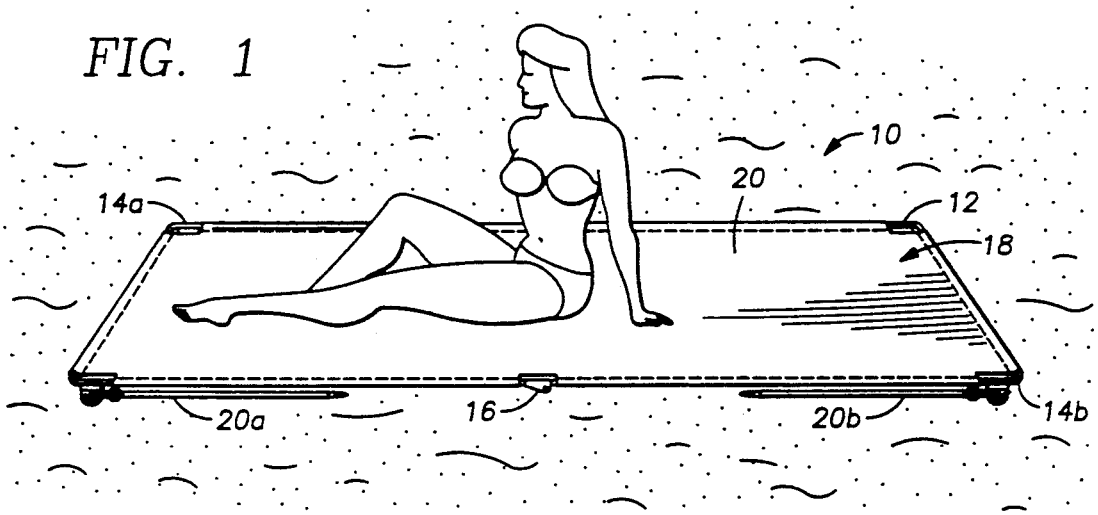
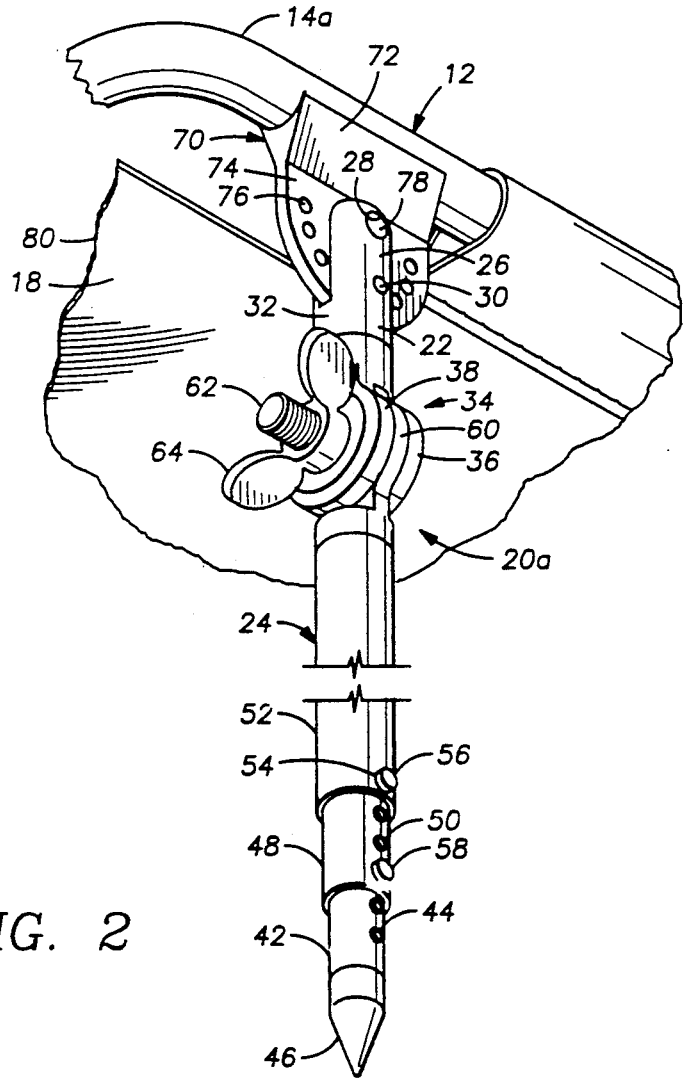
FIG. 2

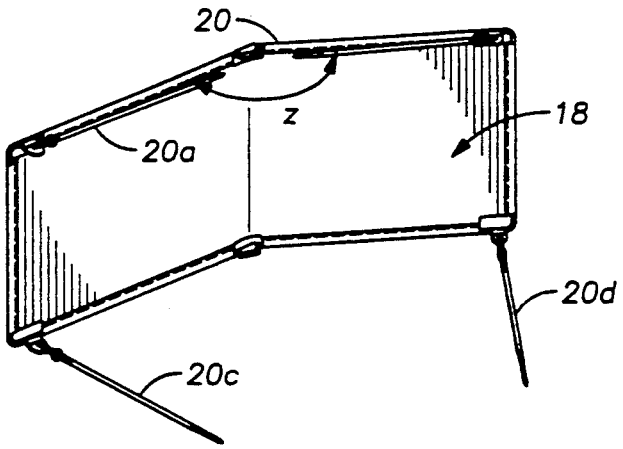
FIG. 7
FIG. 8
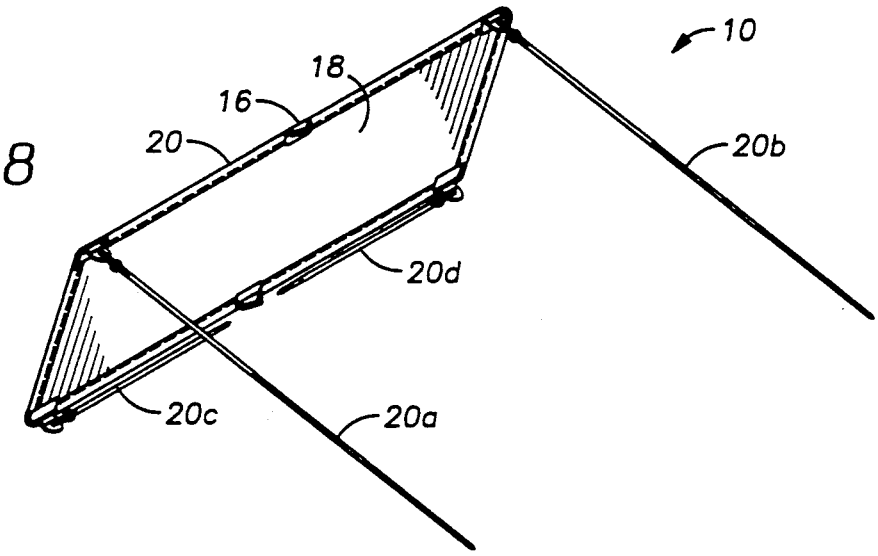
FIG. 9
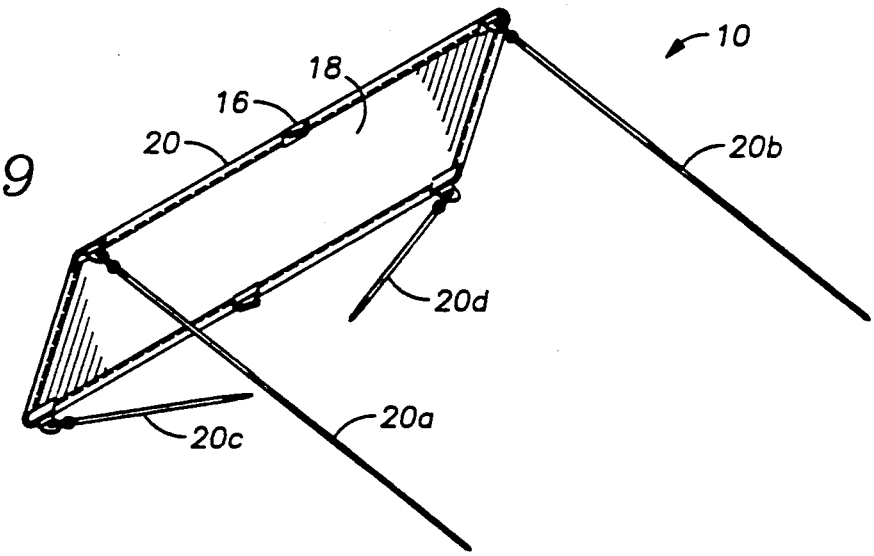

TANNING AND SCREENING APPARATUS

This is a continuation of copending application Ser. No. 07/206,253, filed on June 13, 1988, now abandoned.

TECHNICAL FIELD OF THE INVENTION

The present invention relates to the field of sun reflecting equipment and more particularly, to an apparatus which may be used, in one mode of operation, as a sun tanning apparatus by reflecting the rays of the sun towards the direction of an individual desiring to enhance his sun tanning and, in another mode of operation, as a screening apparatus which shields an individual from the sun and/or the wind. Still more particularly, the present invention relates to an apparatus, which because of its unique construction, may assume a plurality of adjustable positions, configurations and orientations to effect either tanning or screening.

BACKGROUND OF THE INVENTION

In an effort to improve their appearance and to project an image of health and vigor, many people have chosen to darken or tan their skin by exposing it to sources of natural or artificial radiation, promoting the production of melanin pigment therein. In their pursuit of a deep and uniform tan, such persons spend a considerable amount of time, while frequently changing positions, under the sun at a beach, swimming pool, lake, or the like, or under radiation emitting lamps or similar devices indoors, at the expense of other more productive or enjoyable activities.

In the past, in order to achieve a deep and uniform tan in a short period of time, reflectors have been used in con]junction with sun lamps. Those reflectors, however, were constructed for use with sun lamps only, were heavy, bulky, and not transportable, and as a result they could not be used conveniently outdoors. Furthermore, those reflectors were typically not adjustable to effect a directional change to the radiation reflection path.

Tanning blankets made out of flexible material with sun reflecting properties have also been used in the past to improve the tanning process. Those blankets are typically placed on the ground for the individual to lie upon. One disadvantage of those blankets is that they are easily displaceable by the wind or the user, so they cannot be maintained in a substantially flat and extended position. Another disadvantage is that they cannot be used in any position, other than horizontal, unless special support poles or the like are used.

Although the aesthetic benefits of suntanning have been vigorously pursued by millions of people, it is well known that prolonged exposure to the sun leads to a multitude of health related problems including drying of the skin, headaches, fatigue, discomfort, severe burning of the skin, and, sadly but all too often, skin cancer. Furthermore, it is well known that the comfort of individuals sunbathing in outdoor places such as the beach, pools, and the like, is oftentimes compromised by unwelcome gusts of wind, blowing dust or sand, and the like, frequently disturbing reading, sleeping, eating or drinking, or other activity in which the sunbather is occupied. In the past, in order to reduce exposure to the sun and/or to reduce the discomfort caused by the wind and flying particulates, well known devices such as umbrellas, canopies and similar devices have been used to provide a screen or shield from the sun and wind. Those devices, however, have several disadvantages including relatively limited positioning capability, limited versatility, and bulkiness or limited portability. For example, an umbrella may not be adjusted to a multitude of positions required to protect an individual lying on the ground from the sun and may provide only limited protection from the wind. Furthermore, a canopy, a tent or the like is not readily adjustable to effect such protection when the position of the sun or the direction of the wind changes.

Another disadvantage of the prior art sun reflecting and sun screening devices is that none of those devices can be used to enhance the tanning process in one mode of operation and to provide screening of the sun and wind in another mode.

All the aforementioned disadvantages of the prior art have been eliminated by the present invention by providing an apparatus which may be used, in one mode of operation, as a sun reflecting device to accelerate the tanning process and, in another mode of operation, as a screening device to provide a shield for the sun and/or the wind. Furthermore, the invention may be used as a lounging mat to lie upon for avoiding the potential discomfort or hazards which one might encounter by lying directly on the sand or ground, without being easily displaced. Because of its unique construction, the apparatus of this invention may be positioned accordingly as the position of the sun or the direction of the wind changes These and various other objects and advantages of the present invention will become readily apparent to those skilled in the art upon reading the following detailed description and claims and by referring to the accompanying drawings.

SUMMARY OF THE INVENTION

Accordingly, the present invention discloses a sun reflecting and a sun screening apparatus having a generally rectangular folding frame. The frame is formed by connecting the open ends of two U-shaped frame members by incrementally positionable locking hinge means.

A flat panel having a sun reflecting surface is attached to the four sides of the frame. The panel extends over substantially the entire area between the sides of the frame and serves as a sun reflecting surface or a sun or wind shielding surface.

Four telescopically extendable legs are attached to the frame by pivot means. Each leg includes an upper portion or strut and a lower portion or shank. The strut and the shank are pivotally connected by a frictional coupling that allows the pivotal adjustment of the direction of the shank with respect to the strut. The shank is comprised of a lower tubular member, an inner sleeve slidingly received over the lower tubular member and an outer sleeve slidingly received over the inner sleeve. The length of the shank is adjustable by telescopically adjusting the relative positions of the lower tubular member and the inner and outer sleeves, and locking them in position by inserting a locking pin radially into the inner sleeve and the tubular member and inserting another locking pin radially into the outer and inner sleeves.

In order to form the pivotal connection between each leg and the frame, a pivot plate which is integrally connected to the frame is inserted into a slot of a clevis in the upper end of the strut. A pivot pin is inserted through the clevis and the pivot plate and the strut is allowed to rotate around the pivot pin. The direction of the strut is locked by inserting another locking pin through the clevis and one of a plurality of apertures in the pivot plate. The pivotal connections between the pivot plate and the strut, and the strut and the shank, facilitate a plurality of directional adjustments of the legs.

BRIEF DESCRIPTION OF THE DRAWINGS

For a detailed description of the preferred embodiment of the invention, reference will now be made to the accompanying drawings, wherein:

FIG. 1 is a perspective side view of the apparatus of the present invention being used as a lounging mat and a tanning device, with the legs folded under the frame;

FIG. 2 is a fragmentary view of a portion of the apparatus shown in FIG. 1, with a leg extended downwardly from the frame;

FIG. 7 is an isometric view of the apparatus of FIG. 1 in a configuration used to shield an individual from the wind;

FIG. 8 is an isometric view of the apparatus of FIG. 1 in another configuration used to shield an individual from the wind, and from the sun when it is lower on the horizon; and FIG. 9 is an isometric view of the apparatus of FIG. 1 in still another configuration used to shield an individual from the wind, and from the sun when it is also lower on the horizon.

DESCRIPTION OF THE PREFERRED EMBODIMENT

Figure 3:
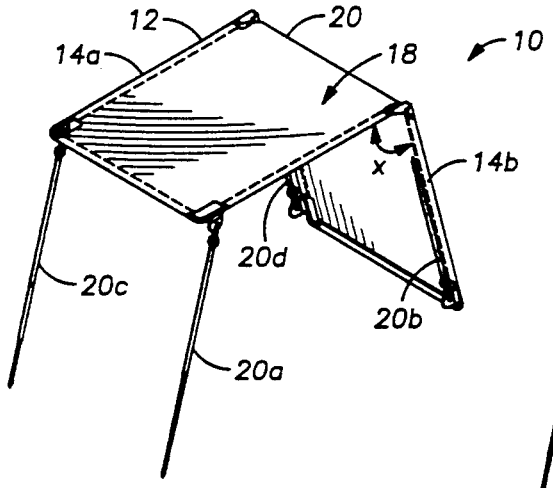
FIG. 3 is an isometric view of the apparatus of FIG. 1 in a configuration used to shield an individual from the sun.

The present invention discloses a tanning and a screening apparatus having a folding, generally rectangular frame and four extendable and pivotally adjustable legs attached thereto. A panel having a sun reflecting surface is attached to the four sides of the frame. In one mode of operation, the apparatus is used as a lounging mat so that a person may lie on it outdoors under the sun or indoors under an artificial sun lamp or the like. The natural or artificial rays are reflected by the sun reflecting surface onto the body of the user to promote tanning. In another mode of operation, the apparatus may be used as a tanning surface placed adjacent to a person to effect a similar reflection and tanning. In yet another mode of operation, the apparatus may be used as a screening device to shield a person from the sun and/or the wind.

The apparatus is positionable in a plurality of positions and heights by extending the legs, changing the direction of the legs, and/or partially folding the frame. The apparatus is constructed using lightweight material and may be easily folded into a smaller, easily transportable configuration.

Referring now to FIG. 1, there is shown a tanning and screening apparatus 10 being used as a lounging mat by a person under the sun, e.g., at the beach. Tanning and screening apparatus 10 includes a generally rectangular frame 12 having four slightly curved corners. Frame 12 is shown in a fully unfolded or extended position. Frame 12 includes two substantially U-shaped tubular frame members **14*a* and 14*b* whose open ends are connected by incrementally positionable locking hinge means 16, well known in the art. U-shaped tubular frame members 14*a* and 14*b* are preferably made out of a relatively strong but light-weight material, such as aluminum, pvc, or other suitable metal or plastic. The relative position of frame member 14*b* may be incrementally adjusted with respect to frame member 14*a*, around the pivot axis of hinge means 16, through about 180° to any position between a fully unfolded or extended position, as shown in FIG. 1, and a fully folded position (not shown) wherein frame member 14*b* is folded over frame member 14*a*. This positioning adjustment is accomplished by first bringing frame 12 to a fully extended position wherein frame member 14*b* is in substantially the same plane as frame member 14*a*, and then pivotally rotating frame member 14*b* around the pivot axis formed by hinge means 16 to the desired position, which will be maintained by hinge means 16** as is well known in the art.

A substantially opaque panel 18 having a sun reflecting surface 20, a generally rectangular body, and tabs extending outwardly therefrom on all four sides is stretched across frame 12, and the tabs of panel 18 are pulled over and about the four sides of the frame and are secured to the panel body by stitching or other suitable fastening means. Sun reflecting surface 20 may comprise either a separate panel material or laminate having sun reflecting properties which is stitched or otherwise attached to the body of panel 18, which, for example, may be a canvas material, or an integral part of panel 18, prefabricated as such. That is, in the latter case panel 18 may be made in one piece, entirely of sun reflecting material. Any flexible material having suitable sun reflecting properties, and which is not uncomfortable to lie on, may be used to fabricate sun reflecting surface 20. Sun reflecting surface 20 as used herein means and includes a surface which reflects the sun's rays or the rays from a sun lamp or the like, including those ultraviolet or other rays primarily responsible for effecting tanning of the skin. An example of such a material is the silver tanning blanket sold by Metallized Products of Winchester, Massachusetts.

Tanning and screening apparatus 10 further includes legs **20*a*, 20*b*, 20*c* (FIG. 3) and 20*d* (FIG. 3). Each leg is pivotally connected to frame 12 adjacent to one of each of the four corners of frame 12. Legs 20*a* and 20*b* are shown in FIG. 1** in a fully retracted and a fully folded position.

Tanning and screening apparatus 10, as shown in FIG. 1, separates the person from the ground underneath and reflects the rays of the sun or of the artificial sun lamp or the like, not only to the exposed portions of the body facing the sun, lamp or the like, but also to those exposed portions of the body that are not directly facing the sun or lamp. As a result, the apparatus of the invention not only accelerates the tanning process of the exposed portions of the body facing the sun or lamp, but it also promotes the tanning process of the exposed portions of the body that are not directly facing the sun or lamp.

For a detailed description of leg **20*a* and its pivotal connection to frame 12, reference is now made to FIG. 2. It should be understood that because legs 20*b*, 20*c* and 20*d* and the pivotal connection thereof to frame 12 are similar to leg 20***a* and its pivotal connection to frame 12, the detailed description of leg 20*a* and its pivotal connection to frame 12 is also applicable to legs 20*b*, 20*c*, and 20*d*.

Leg 20*a* includes a strut 22 and a shank 24. Strut 22 includes an upper clevis 26 having an upper aperture 28 and a lower aperture 30, apertures 28, 30 extending transversely through both sides of clevis 26. A slot 32 is formed by clevis 26. Strut 22 further includes a lower clevis 34 which is formed by two parallel round plates 36 and 38 having a gap or slot therebetween. Clevis 34 includes a transversely extending bore or aperture (not shown) running concentrically through the centers of plates 36 and 38.

Shank 24 includes a lower tubular member 42 having a plurality of transversely extending apertures 44 therein and a softly curved or pointed free end 46. Shank 24 further includes an inner sleeve 48 having a plurality of transversely extending apertures 50 therein, and being slidingly received over lower tubular member 42. Shank 24 further includes an outer sleeve 52 having a transversely extending aperture 54 therein, and being slidingly received over inner sleeve 48. The length of shank 24 is adjustable by telescopically adjusting the position of inner sleeve 48 over tubular member 42, and/or the position of outer sleeve 54 over inner sleeve 48. A locking pin 56 is inserted through aperture 54 and one of apertures 50 to lock the engagement between outer sleeve 52 and inner sleeve 48, and another locking pin 58 is inserted in another of apertures 50 and in one of apertures 44 to lock the engagement between inner sleeve 48 and tubular member 42.

The upper end of shank 24 includes a flat round plate 60 which is similar to flat plates 36 and 38 and which is slidingly insertable into the slot formed between plates 36 and 38. Plate 60 has a bore or aperture extending through its center, and concentric with the bores in plates 36, 38 when plate 60 is inserted therebetween.

In the assembled position, plate 60 is inserted into the slot formed between plates 36 and 38 of clevis 34. A bolt 62 is inserted through the coaxial apertures of plate 60 and clevis 34. A wing nut 64 is threaded onto the threaded end of bolt 62. Wing nut 64 may be screwed farther onto bolt 62 to apply pressure against the exterior surfaces of plates 36 and 38 and to squeeze plate 60 between them. Plates 36, 38, and 60, and bolt 62 and wing nut 64, form a frictional coupling which permits pivotal movement or rotation of shank 24 with respect to the longitudinal axis of bolt 62. When wing nut 64 is advanced towards the head of bolt 62, plates 36 and 38 are compressed against plate 60. Sufficient tightening of nut 64 prevents the pivotal movement of shank 24 around bolt 62. When wing nut 64 is sufficiently loosened, the interfacial engagement between plates 36, 60, and 38 is relaxed, and shank 24 is pivotally movable to a new position.

Still referring to FIG. 2, there is shown a connector 70 having a connector head 72 and a semi-circular pivot plate 74 depending from connector head 72. Connector head 72 is securely affixed to U-shaped frame member 14*a*, as by welding, riveting or other suitable means. Pivot plate 74 includes a central pivot aperture (not shown) and a plurality of semi-circularly disposed or planetary locking apertures 76 near its circumferential periphery. In the assembled position pivot plate 74 is received into the slot formed by upper clevis 26 and a pivot pin 78 is inserted through aperture 28 and through the central pivot aperture of pivot plate 74. Pivot pin 78 is sufficiently secured to allow leg 20*a* to rotate around the longitudinal axis of pivot pin 78. The pivotal or radial position of leg 20*a* on plate 74 may be adjusted and fixed by aligning aperture 30 with on of planetary apertures 76 and by inserting a locking pin 80 therethrough to prevent further pivotal movement of leg 20*a* around pivot pin 78. It should be understood that connectors similar to connector 70 are integrally attached adjacent to the remaining three corners of frame 12 to accommodate a similar pivotal attachment of legs 20*b*, 20*c*, and 20*d* to frame 12.

Because of the pivotal connection between legs 20*a*, 20*b*, 20*c*, and 20*d* and frame 12, the pivotal frictional coupling between the struts and shanks of each leg, the extendability of legs 20*a*, 20*b*, 20*c* and 20*d*, and the pivotal coupling between U-shaped frame members 14*a* and 14*b*, tanning and screening apparatus 10 is very versatile and may be adjusted to a plurality of positions and configurations to accommodate the user.

Figure 4:
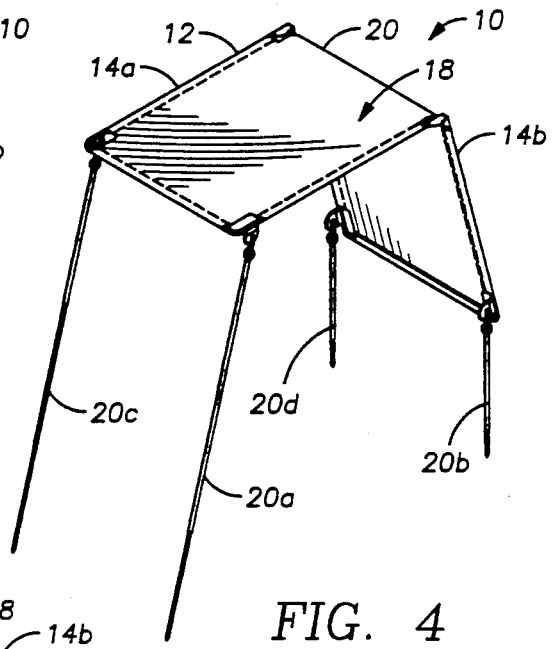
FIG. 4 is an isometric view of the apparatus of FIG. 1 in another configuration used to shield an individual from the sun.
Figure 5:
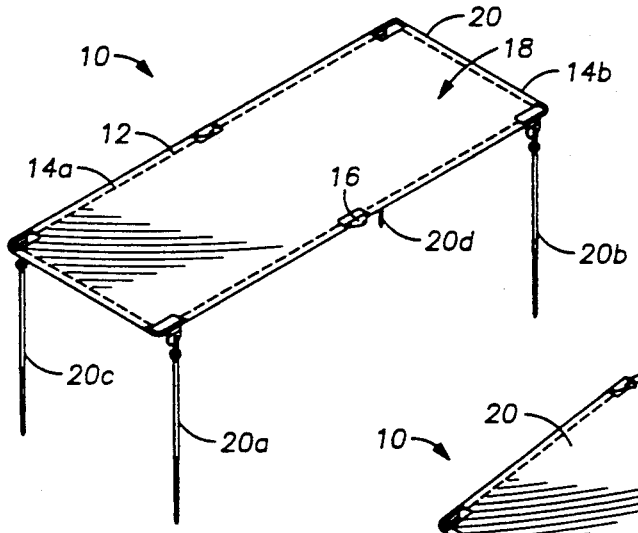
FIG. 5 is an isometric view of the apparatus of FIG. 1 in still another configuration used to shield an individual from the sun.

FIGS. 3, 4, 5 and show different configurations of tanning and screening apparatus 10 used as a sun shield. FIG. 3 shows frame 12 with U-shaped frame member 14*b* being securely positioned with respect to U-shaped frame member 14*a* at an angle x. Legs 20*b* and 20*d* are retracted and folded onto U-shaped frame member 14*b*, and U-shaped frame member 14*b* is self-supported through its closed end abutting the ground. Legs 20*a* and 20*c* are partially extended outwardly, away from and supporting U-shaped frame member 14*a* which is substantially parallel to the ground. Panel 18 provides a shield for the sun and possibly the wind, and reflecting surface 20 reflects the rays of the sun thereby reducing the heating impact of the sun in the area under tanning and screening apparatus 10. The user can easily lie or recline under apparatus 10 and be shielded from the sun, and possibly the wind.

FIG. 4 shows a configuration similar to that shown in FIG. 3 except that legs 20*a* and 20*c* are fully extended and legs 20*b* and 20*d* are unfolded. Legs 20*b* and 20*d* are used to provide support for U-shaped frame member 14*b* and to raise U-shaped frame member 14*b* thereby increasing the clearance between panel 18 and the ground. The user can easily sit up, lie, or recline under apparatus 10 and be shielded from the sun, and possibly the wind.

FIG. 5 shows a tanning and screening apparatus 10 having a fully extended frame 12 with U-shaped frame members 14*a* and 14*b* being substantially in the same plane. Legs 20*a*, 20*b*, 20*c*, and 20*d* extend perpendicularly and downwardly from frame 12, at an equal length, to support frame 12 and panel 18 in a substantially horizontal position. In this position, the user can lie underneath panel 18 and be substantially shielded from the sun, and possibly the wind. It is not contemplated that the user lie on top of panel 18 with the legs in any but a completely folded position, since the frame and extended legs might not be strong enough to support the user's weight. In order to be sufficiently portable and convenient to transport to the beach, for example, the present apparatus should be made of relatively lightweight materials, as mentioned previously. Use of lightweight materials does not necessarily mean that the apparatus could not be constructed to support the user's weight, however. It is well known, for example, that aluminum is relatively strong although light, and that canvas is a relatively strong fabric. Thus, it should be understood that if the user desires to lie upon the apparatus in the position shown in FIG. 5, he or she must first be certain that the structural integrity and stability of the apparatus is such as will not fail under his or her weight.

Figure 6:
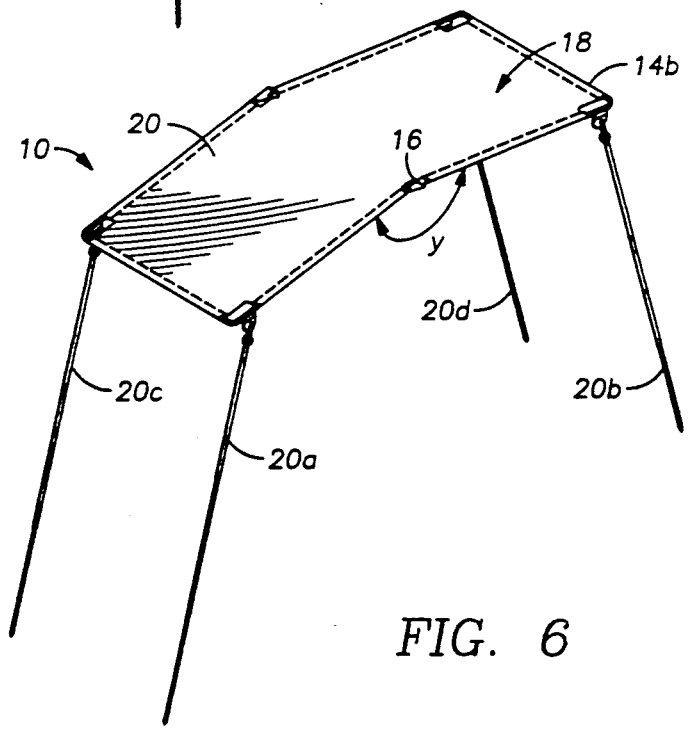
FIG. 6 is an isometric view of the apparatus of FIG. 1 in still another configuration used to shield an individual from the sun.

FIG. 6 shows another configuration of tanning and screening apparatus 10 with the middle of frame 12 being raised to place U-shaped frame member 14*b* at an angular position y with respect to U-shaped frame member 14*a*. Legs 20*a*, 20*b*, 20*c*, and 20*d* extend downwardly and outwardly in a slightly angular position to support frame 12 and panel 18. The user can easily sit up, lie, recline, or possibly stand up under panel 18 and be shielded from the sun, and again, possibly the wind.

FIGS. 7, 8 and 9 show different configurations of tanning and screening apparatus 10 being used as a wind shielding device, and possibly shielding the sun as well. Referring now to FIG. 7, there is shown tanning and screening apparatus 10 with U-shaped frame member 14*b* being at an angle z with respect to U-shaped frame member 14*a*. One side of frame 12 abuts the ground and panel 18 is substantially perpendicular to the ground. Tanning and screening apparatus 10 is supported in a generally perpendicular position by a support base formed by legs 20*c* and 20*d* extending from frame 12. Legs 20*a* and 20*b* are fully retracted and folded on frame 12. This configuration of apparatus 10 protects the user from wind coming generally toward the side of apparatus 10 opposite to that having legs 20*a*, 20*b*, 20*c*, and 20*d*. FIG. 8 shows tanning and screening apparatus 10 with frame 12 fully open or extended. One of the sides of frame 12 abuts the ground while the other side is elevated and supported by fully extended legs 20*a* and 20*b*. Legs 20*c* and 20*d* are fully retracted and folded on frame 12. This configuration may be used to shield the user from wind coming generally from the same direction as discussed in connection with FIG. 7, but may also be used to shield the user from the sun when it is relatively low on the horizon. The configuration of tanning and screening apparatus 10 shown in FIG. 9 is similar to that shown in FIG. 8 except that legs 20*c* and 20*d* are partially unfolded to provide additional base support for frame 12.

Although the size (length and width) of tanning and screening apparatus 10 shown in the drawings is one that would accommodate use by a person of average size, tanning and screening apparatus 10 may be constructed in several sizes to accommodate the use thereof by a large individual, e.g., extra length or width, or by two or more individuals, e.g., double width. Furthermore, as mentioned previously, although apparatus 10 is preferably constructed of lightweight material intended to support one or more persons only as a lounging mat, it may also be constructed of stronger material designed to support one or more persons off the ground in other positions, such as the one shown in FIG. 5.

Thus, the foregoing detailed description has demonstrated the construction of a versatile, light, easily transportable apparatus capable of assuming a plurality of positions and configurations and which may be used as a tanning device in one mode of operation, and as a screening device in another mode. While a preferred embodiment of the invention has been shown and described, modification thereof can be made by one skilled in the art without departing from the spirit of the invention. For example, the telescoping, pivotally adjustable legs need not include two separate pivotal connections, one between a strut and the frame and another between the strut and a shank. Instead, the legs may be connected to the frame with a ball-and-socket type connector, with suitable locking means incorporated therein to maintain the position of the legs with respect to the frame. In this case, only one such connection need be provided for each leg, and the remainder of the leg below the connector may comprise simply the telescoping outer and inner sleeves, and lower tubular member.

We claim:

1. A tanning and screening apparatus alternatively to reflect the rays of the sum or a sun lamp towards a user, or to protect the user from such rays, comprising:

an elongate rectangular frame having a central hinged portion, the axis of rotation of said hinged portion running transversely across said rectangular frame substantially at its center and enabling said frame alternately to be opened flat or to be doubled back on itself, said frame further including releasable locking means for maintaining said frame in substantially any position between such opened flat configuration and such doubled back configuration;

a panel attached to said frame, said panel having a sun reflecting surface for reflecting toward the user such rays including those ultraviolet or other rays primarily responsible for effecting tanning of the user's skin in order to promote and accelerate the tanning process when the user is positioned to receive the reflected rays, and for shielding the user from such rays when placed between the source of such rays and the user; and telescopically extendable, incrementally lockable leg means pivotally attached to each of the four corners of said rectangular shaped frame for selectively supporting each of said corners of said frame off the ground, floor, or the like an incremental distance from none or substantially only a minimal distance, equal to the thickness of or a partial thickness of said leg means, to the maximum distance permitted by said telescopically extendable leg means, said hinged frame and said telescopically extendable, incrementally lockable leg means comprising means for securing said tanning and screening apparatus in any of a plurality of positions comprising a flat opened position with said legs folded underneath said frame, said corners being supported substantially only a minimal distance above the ground or the like; a flat opened position with said legs extended substantially the same amount to support the four corners of the frame substantially the same distance above the ground or the like; a flat opened position with two corners of said frame on the same longitudinal side thereof supported not at all or only minimally by the respective ones of said legs, and the two remaining sides being supported above the ground or the like by the respective ones of said incrementally extendable telescoping legs; a bent frame position with two corners of said bent frame on the same longitudinal side thereof being supported above the ground or the like not at all or only minimally by said frame, and the two remaining sides being free of support from said legs on the same longitudinal side of said frame; and a canopy position with the frame in a bent orientation and both legs of a pair of legs on the same end of said frame being alternately pivoted under said frame and away from supporting said corners above the ground or the like, or extended an equal amount from substantially none to the maximum permitted by such telescopingly extendable leg means, such that the respective corners of said frame are supported alternately not at all or only minimally, or substantially the same distance above the ground or the like.

2. Tanning and screening apparatus according to claim 1, wherein:

said panel comprises a flexible material; and said frame includes:

a first U-shaped frame member having an open end;

a second U-shaped frame member having an open end; and means including said releasable locking means for pivotally connecting the open end of the first U-shaped frame member to the open end of the second U-shaped frame member.

3. Tanning and screening apparatus according to claim 2, wherein said means for pivotally connecting together the open ends of the U-shaped frame members includes an incrementally positionable locking hinge.

4. Tanning and screening apparatus according to claim 2, wherein said leg means includes a first leg connected to a corner of said frame and having a strut member pivotally attached to said frame allowing pivoting of said strut member with respect to said frame in a first plane, and a shank member pivotally attached to said strut member allowing pivoting of said shank member with respect to said strut member in a second plane.

5. Tanning and screening apparatus according to claim 4, wherein said first plane is substantially perpendicular to said frame, and said second plane is substantially perpendicular to said first plane.

6. Tanning and screening apparatus according to claim 4, wherein said shank member of said first leg is telescopically extendable.

7. Tanning and screening apparatus according to claim 4, wherein said shank member of said first leg includes an outer sleeve pivotally connected to said strut member, an inner sleeve telescopingly received within the outer sleeve, and a lower tubular member telescopingly received within the inner sleeve, and including first shank locking means disposed between said outer and inner sleeves for releasably locking the position of said inner sleeve within said outer sleeve, and second shank locking means disposed between said inner sleeve and said lower tubular member for releasably locking the position of said lower tubular member within said inner sleeve.

8. Tanning and screening apparatus according to claim 7, further including third shank locking means disposed between said shank member and said strut member for releasably locking the position of said shank member with respect to said strut member, and strut locking means disposed between said strut member and said frame for releasably locking the position of said strut member with respect to said frame.

9. Tanning and screening apparatus according to claim 8, wherein said leg means includes a second, a third, and a fourth leg pivotally attached to the other three corners of said frame, each of said first, second, third, and fourth legs being substantially identical to on another.

10. Tanning and screening apparatus according to claim 9, wherein the pivotal attachment of each of said legs to said frame includes a pivot plate disposed on said frame, a first clevis disposed on the respective strut member and having a slot for receiving said pivot plate, a pivot pin disposed in a pivot aperture through said clevis and said pivot plate for permitting rotation of said strut member with respect to said pivot plate but preventing separation thereof, a plurality of locking apertures circumferentially disposed through said pivot plate near its periphery, a locking aperture disposed through said clevis of said strut member and spaced from said pivot aperture, and a strut locking pin selectively insertable in said locking aperture of said clevis and one of said locking apertures in said pivot plate for preventing rotation of said strut member with respect to said pivot plate.

11. Tanning and screening apparatus according to claim 10, wherein the pivotal attachment of each of said shank members to said strut members of said legs includes a pair of clevis plates disposed on the end of said strut member opposite to that having said first clevis, said clevis plates being substantially perpendicular to said pivot plate, a plate disposed on the end of said outer sleeve opposite to that receiving said inner sleeve and received between said clevis plates of said strut member, a bore extending through said clevis plates and said outer sleeve plate, a bolt disposed in said bore, and a wing nut threadingly disposed on said bolt.

12. Tanning and screening apparatus according to claim 4, wherein said shank member includes a rounded point on its free end.

13. Tanning and screening apparatus according to claim 2, wherein said panel is substantially opaque.

14. Tanning and screening apparatus according to claim 2, wherein said panel comprises a silver tanning blanket material.

15. Tanning and screening apparatus according to claim 14, wherein said panel comprises a canvas base and said tanning blanket material is attached to said canvas base, said canvas base having a generally rectangular body with outwardly extending tabs, said tabs being connected to said body around said frame, and said body substantially covering said frame.

16. Tanning and screening apparatus according to claim 14, said panel having a generally rectangular body with outwardly extending tabs, said tabs being connected to said body around said frame, and said body substantially covering said frame.

* * * * *